US005242745A

United States Patent [19]

Aucagne et al.

[11] Patent Number: 5,242,745

[45] Date of Patent: Sep. 7, 1993

[54] SPIRAL-SHAPED TEXTILE STRUCTURE

[75] Inventors: Jean Aucagne, La Tour du Pin; Laurent Martinet, Lyons, both of France

[73] Assignee: Brochier S.A., Decines, France

[21] Appl. No.: 601,803

[22] PCT Filed: Feb. 26, 1990

[86] PCT No.: PCT/FR90/00135

§ 371 Date: Oct. 29, 1990

§ 102(e) Date: Oct. 29, 1990

[87] PCT Pub. No.: WO90/10103

PCT Pub. Date: Sep. 7, 1990

[30] Foreign Application Priority Data

Feb. 27, 1989 [FR] France ..... 89 02519

[51] Int. Cl.[5] ..... D03D 3/00

[52] U.S. Cl. ..... 428/225; 139/11; 139/384 R; 428/257

[58] Field of Search ..... 428/225, 257; 139/11, 139/384 R

[56] References Cited

FOREIGN PATENT DOCUMENTS 454993 7/1913 France .
2414087 8/1979 France .
2490687 3/1982 France .

*Primary Examiner*—James J. Bell
*Attorney, Agent, or Firm*—Wenderoth, Lind & Ponack

[57] ABSTRACT

A spiral-shaped textile structure comprises warp yarns (1-17) across which are passed successive rows of weft yarns (A-S), whereby the warp yarns (1-17) are essentially arranged in spirals having the same axis, so that the textile structure forms superimposed annular spirals centered on an axis (O). According to the invention, each weft yarn (A-S) extends between a warp yarn, known as a starting yarn, and another warp yarn, known as a reference yarn, according to a radius of one of the textile structure's turns. Each warp yarn (1-17) serves, in at least one annular region of the textile structure, as a reference yarn for at least one weft yarn (A-S), the reference yarns being distributed so at to obtain a uniform textile structure in the annular region.

6 Claims, 5 Drawing Sheets

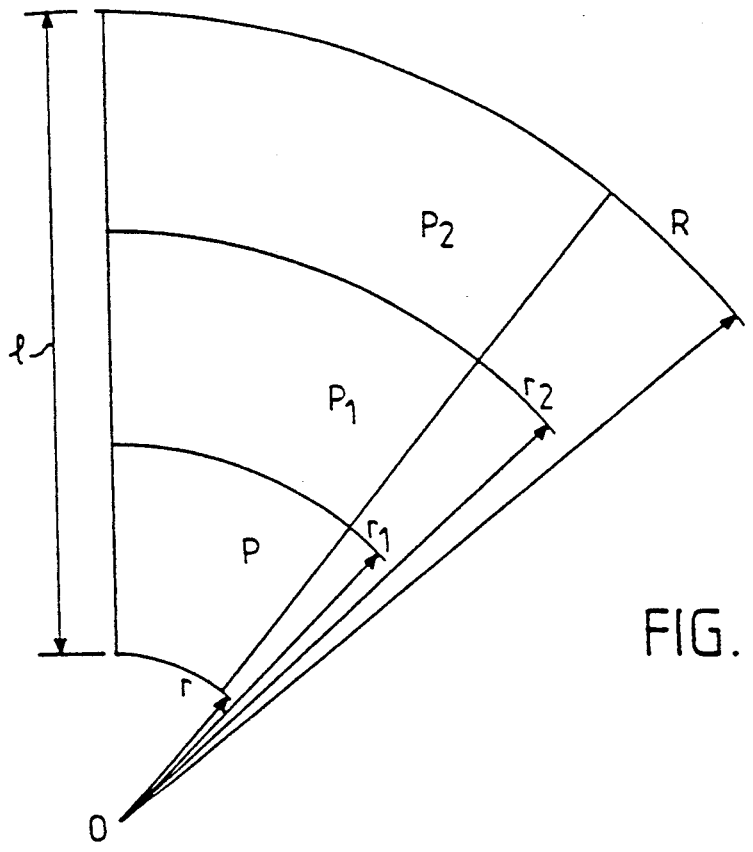
FIG. 6
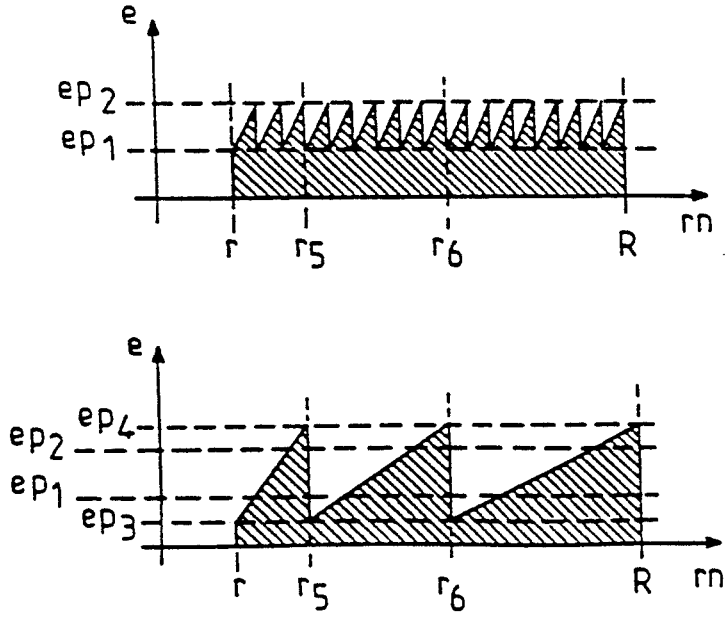
FIG. 9a
FIG. 9b
FIG. 9

SPIRAL-SHAPED TEXTILE STRUCTURE

The present invention relates to a spiral-shaped textile structure comprising warp yarns across which are passed successive rows of weft yarn. It also relates to a process for weaving a spiral-shaped textile structure and a machine for weaving such a structure.

There exist numerous fields in industry which require the use of spiral-shaped fabrics or textile structures. Mention can be made especially of the manufacture of composite pieces of revolution, especially of a wheel, a cone, or a truncated cone type, in particular for pieces intended to be used with a great speed of rotation, such as turbines or compressors, and also of the manufacture of joint type pieces.

In order to make such structures, use was at first considered of pieces of fabric obtained, in a conventional manner, in rectilinear strips. Cutting a spiral shape of such pieces of fabric involves numerous trimmings which increases the cost, all the more since certain pieces of fabric are made of costly materials.

In order to avoid these losses, and to improve the orientation of the fibers, spiral-shaped pieces of fabric have been made using a conventional weaving technique. According to this technique, the warp yarns coming from upstream of the weaving machine are drawn by a tapered take-up roller. The contact surface of this roller with the fabric is a truncated cone, the generating line of which is essentially equal to the width of the fabric. The warp yarns are arranged according to helices having the same axis. The rows of weft yarns are arranged according to the radii of the circles formed by the warp yarns. Upstream of the tapered roller, a comb is positioned, which, after each passage of the weft-threader, brings the weft yarn which has just been inserted into the warp yarns closer against the other weft yarns already woven. These latter, together with the warp yarns, form the fabric which has the form of annular turns.

These pieces of fabric do not have a satisfactory structure.

In fact, the rows of weft yarns extend over the entire width of the fabric. Since they are arranged according to the radii, the separation between two successive rows of weft yarns increases moving away from the inner radius towards the outer radius of the turns of the fabric. This leads to a great variation in the content of fiber in the fabric, which is accentuated all the more with greater the curvature and width of the fabric.

Such spiral-shaped fabrics obtained by means of conventional techniques can therefore not be used in applications which require fabrics which have an essentially uniform fiber density.

A number of techniques were then proposed in order to improve the filling of spiral-shaped fabrics and to render uniform the density of yarn in these fabrics.

By way of illustration, the patent FR-2 490 687 can be cited, which relates to a fabric in a strip of the type comprising warp yarns across which are passed successive rows of weft yarn, the warp yarns being essentially arranged in helices having the same axis, so that the fabric forms superimposed annular turns centered on the axis, the rows of weft yarn being orthogonal to the warp yarns.

In order to improve the filling of the weaving, it is proposed to no longer unwind the weft yarn from the inner radius to the outer radius of the fabric, but to organize the weaving in such a manner that more weft yarns are unwound in those parts of the fabric situated on the side of the outer radius.

This patent advocates delimiting, in the width of the fabric, a plurality of contiguous sections. Each section comprises a number of warp yarns and can be woven independently by virtue of an independent device for selection of the yarns. A weaving plan is defined, which indicates the set of sections to be woven upon each unwinding of the weft needle. Each row of weft yarns thus extends over a set of contiguous sections which is defined so as to provide, in each section crossed by a row of weft yarns, the points of tying corresponding to the weave selected for the fabric and to obtain a predetermined filling of the fabric formed.

In a fabric according to this patent, the density of yarn is certainly improved in relation to that of a fabric obtained by means of conventional weaving techniques, but it is nevertheless still not optimal. In fact, the structure of this fabric is based on the creation of contiguous sections of warp yarn, the weft yarn carrying out to-and-fro movements in the sections according to a defined weaving plan. The limits between two contiguous sections serve as reference for the return points of the weft yarns.

This leads to an increase in the thickness on the inside of each section, from the limit situated on the side of the outer radius of the fabric towards the limit situated on the side of the inner radius of the fabric. Furthermore, it is to be noted that each limit between two contiguous sections has a discontinuity in surface mass, the surface mass being greater on the side situated towards the outer radius of the fabric than on the side situated towards the inner radius.

It can be noted that the increase in the thickness on the inside of each section is accentuated by the fact that, between two limits, the weft yarns become closer when the limit situated on the side of the inner radius of the fabric is approached, the fiber content increasing correlatively.

It can thus be noted that a spiral-shaped fabric obtained according to patent FR-2 490 687 has great variations in surface mass, particularly in the vicinity of the limits between two contiguous sections, even if the average surface mass over the whole of the fabric corresponds to the desired mass. Furthermore, this fabric has variations in thickness. The fabric obtained therefore does not have good homogeneity and the appearance of this fabric, as well as its mechanical characteristics, has irregularities.

The very old patent FR 454 993 can also be cited, which describes a method of weaving to obtain curved fabrics which do not require the division of the fabric into defined sections.

However, this method does not make it possible to obtain a spiral fabric, because the warp and weft yarns are unwound in one plane, without it being possible to obtain superimposed and centered annular turns. Furthermore, the curved fabric is obtained by providing additional weft strokes in a regular and sequential manner and cannot therefore have good homogeneity in thickness and in surface mass. Consequently, the appearance of this fabric, as well as its mechanical characteristics, has irregularities.

SUMMARY OF THE INVENTION

The subject of the invention is a spiral-shaped textile structure having great uniformity of thickness, of surface mass, of compactness, and consequently, of its mechanical characteristics.

The invention thus relates to a spiral-shaped textile structure comprising warp yarns across which are passed successive rows of weft yarns, the warp yarns being essentially arranged in helices having the same axis, so that the fabric forms superimposed annular turns centered on the axis.

According to the invention, as each weft yarn extends between a warp yarn known as the starting yarn, and another warp yarn known as the reference yarn, according to a radius of one turn of the textile structure, each warp yarn serves, in at least one annular region of the textile structure, as a reference yarn for at least one weft yarn, the reference yarns being distributed so as to obtain a uniform textile structure in the annular region.

In the textile structure according to the invention, the weft yarns are woven so as to provide the points of tying corresponding to the selected weave, such as ribbed twill, satin or taffeta.

Furthermore, the starting yarn can vary on the inside of the structure.

The invention also relates to a process for weaving a spiral-shaped textile structure by means of a weaving machine, according to which a layer of warp yarns is drawn along positively by a call system situated downstream of a comb. The warp yarns, across which weft yarns are unwound in a successive manner, are selected, and the layer of yarns is drawn along by a call system comprising at least one tapered roller so as to obtain a spiral-shaped textile structure.

According to the invention, as each weft yarn extends between a warp yarn, known as the starting yarn, and another warp yarn, known as the reference yarn, according to a radius of one whorl of the textile structure, selection is carried out in at least one annular region of the textile structure so that each warp yarn serves as reference yarn for at least one weft yarn and the reference yarns are distributed in order to obtain a homogeneous textile structure in the annular region.

In the process according to the invention, the weft yarns are woven so as to provide the points of tying corresponding to the selected weave.

Furthermore, different starting yarns are selected on the inside of the textile structure.

Preferably, at least in said annular region, the warp yarns are selected individually and, in the other annular regions, the warp yarns are selected by group.

Preferably, the take-up system is arranged as close as possible to the comb.

According to a first preferred embodiment, as the take-up system comprises at least one tapered roller, the tapered roller situated as close as possible to the comb and is arranged so that the fabric formed downstream of the comb remains in a plane to which the take-up roller is tangent along a generating line.

According to a second preferred embodiment, the tapered roller situated closest to the comb and is arranged so that its axis is parallel to the last row of weft yarn unwound.

Preferably, the fabric formed is rolled up according to a helicoidal arrangement.

The invention also relates to a machine for weaving a spiral-shaped textile structure, comprising a take-up system situated downstream of a comb for the positive drawing along of a layer of warp yarns, and a means of selection of the warp yarns across which are unwound successive rows of weft yarn, this take-up system comprising at least one tapered roller.

According to the invention, the means of selection comprises at least a means of individually selecting the warp yarns.

Preferably, the means of selection are constituted by at least one device for independent selection of the warp yarns.

Preferably, the means of selection comprises at least one device for selection by a group of warp yarns.

Preferably, at least one tapered roller has a nonsliding surface.

Preferably, the take-up system is situated as close as possible to the comb.

According to a first preferred embodiment, the roller closest to the comb is tangent along a generating line to the plane of the fabric formed downstream of the comb.

According to a second preferred embodiment, the roller closest to the comb has its axis parallel to the last row of weft yarn unwound.

Other objects advantages and characteristics of the use of invention will be apparent from the following description of the invention, in conjunction with the accompanying drawings in which:

FIG. 1 is a view from above of a a portion of spiral-shaped textile structure, FIG. 2 represents a sector of an angle of 90° of the portion of the textile structure in FIG. 1, FIG. 3 illustrates an example of the textile structure according to the invention, FIG. 4 illustrates a first example of a spiral-shaped textile structure not having the technical characteristics according to the invention, FIG. 5 illustrates a second example of a spiral-shaped textile structure not having the technical characteristics according to the invention, FIG. 6 represents an alternative embodiment of the textile structure according to the invention, FIG. 7 is a schematic view from above of a weaving machine according to the invention, FIG. 8 is a schematic side view of a weaving machine according to the invention, and FIG. 9 consists of FIGS. 9*a* and 9*b*, which are graphs which make it possible to compare the thickness of the textile structure according to the invention with that of conventional spiral fabrics.

DETAILED DESCRIPTION OF THE PREFERRED EMBODIMENTS

Figure 1:
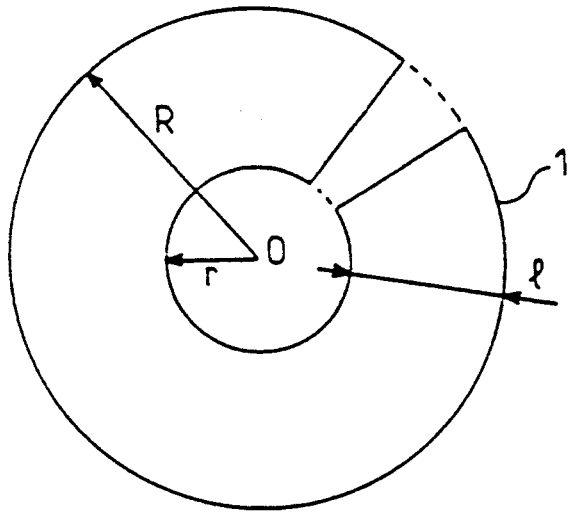

FIG. 1 shows, seen from above, a portion 1 of spiral-shaped textile structure. The textile structure takes the form of a strip which describes a spiral of constant inner radius r and outer radius R, r and R having the same origin, the point O, which is a point of an axis a—a that is perpendicular to the plane of the warp yarns.

The width of the fabric, 1, is equal to the difference between the radii R and r. The fabric rolls up on itself, during weaving, in superimposed annular turns. The rolling up is carried out, as the case may be, with manual or mechanical assistance as indicated below.

Figure 2:
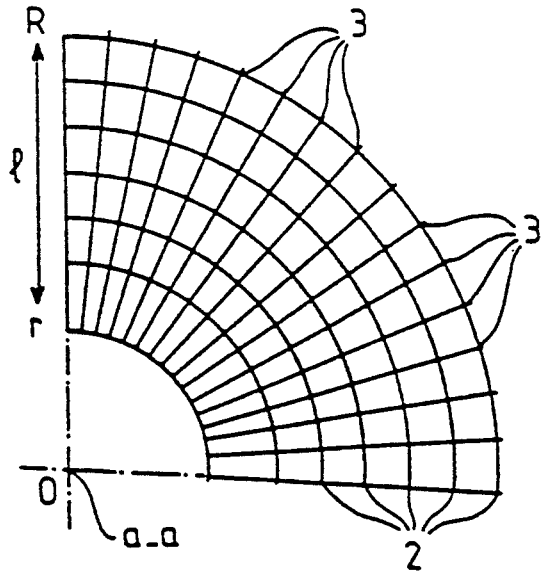

With reference to FIG. 2, the textile structure is composed of warp yarns 2, arranged according to helices having the same axis a—a and having a pitch essentially equal to the thickness of the fabric. It can practically be assumed that each turn is virtually plane and that the warp yarns, or circumferential yarns, are arranged according to concentric circles centered on a point of the axis a—a.

The textile structure moreover comprises weft yarns 3, each weft yarn being arranged according to a radius of one turn of the fabric.

Figure 3:
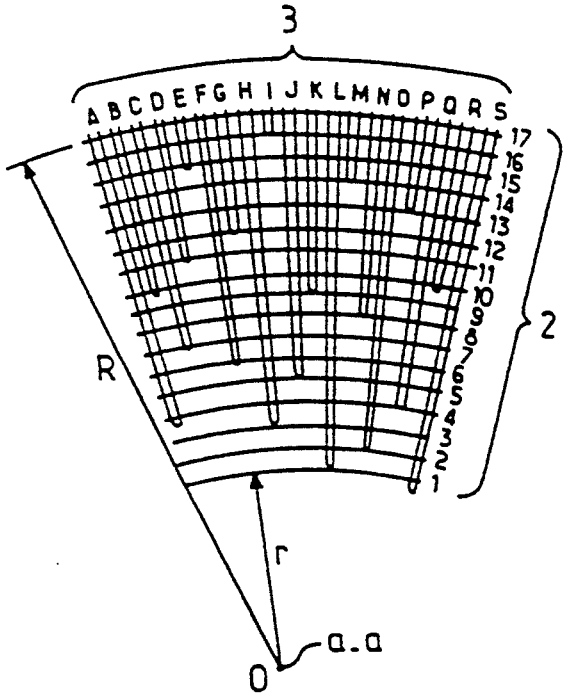

With reference to FIG. 3, a textile structure according to the invention will now be described.

The structure illustrated in FIG. 3 has been woven on a shuttle loom. Each weft yarn 3 thus carries out a to-and-fro movement. If the textile structure is woven on a rapier weaving machine, the weft yarns no longer carry out a to-and-fro movement and one single yarn corresponds to the two yarns obtained by means of weaving by a shuttle loom.

The weaving pattern of the textile structure according to the invention does not depend on the type of weaving machine selected; the latter can be of any type, for example, shuttle, rapier or projectile.

It can be noted here that the type of circumferential and radial yarns which can be used is varied and includes all the types of yarn which are used in textiles, in particular cotton, polyester, glass, carbon, polyamide, silicon carbide, boron, silica, aramid and all artificial or synthetic yarns, especially the yarns known as "technical".

The circumferential and radial yarns are not necessarily of the same type. It is also possible to associate different types of yarns circumferentially and radially.

The radial and circumferential yarns intersect so as to obtain the weave selected beforehand for the textile structure. This weave can be of any type, for example ribbed twill, satin or taffeta.

The number of circumferential and radial yarns per unit length can be adjusted in order to satisfy the predetermined characteristics of the fabric. In particular, this adjustment can be carried out according to the orientation of the stresses to which the piece incorporating the textile structure is to be subjected.

On the portion of textile structure according to the invention represented in FIG. 3, each to-and-fro movement of weft bears as a reference one of the letters A to S, whereas the warp yarns are referenced from 1 to 17.

In the example in FIG. 3, the circumferential yarn from which the weaving is organized—or starting yarn—is the yarn 17 which corresponds to the outer selvage of the fabric. It is understood that the starting yarn can be any one of the warp yarns. This starting yarn is selected according to the technical characteristics which it is desired to obtain in the final piece. It can furthermore be noted that the starting yarn is not necessarily the same in the entire textile structure; it is possible to select different starting yarns in portions of the textile structure of defined length. The starting yarn can in particular be selected according to the position in the textile structure of a possible reinforced region.

The radial yarns are arranged so as to obtain a textile structure of great homogeneity.

In contrast to the patent FR-2 490 687, the weaving of the textile structure according to the invention is not based on the creation of contiguous sections of a number of circumferential yarns. Each warp yarn is treated in an independent manner by virtue of at least one device for independent selection of the yarns, as indicated below.

By controlling the means of selection of the yarns in an appropriate manner, it is possible to obtain the textile structure illustrated in FIG. 3.

Each weft yarn extends between the warp yarn 17, or starting yarn, and another warp yarn which is to be designated as the reference yarn. This reference yarn is the yarn on which the return of the weft yarn is carried out in a case in which the weaving machine used is a shuttle loom.

The reference yarn thus corresponds to what is designated as the point of return or the point of increase of the associated weft yarn.

It can be noted, in FIG. 3, that each of the circumferential yarns 1 to 17 serves as reference yarn for at least one radial yarn. Thus, for example, the yarn A has yarn 4 as reference yarn, yarn B yarn 10, yarn 10 also serving as reference yarn for yarn R, and yarn N has yarn 8 as reference yarn.

Figure 4:
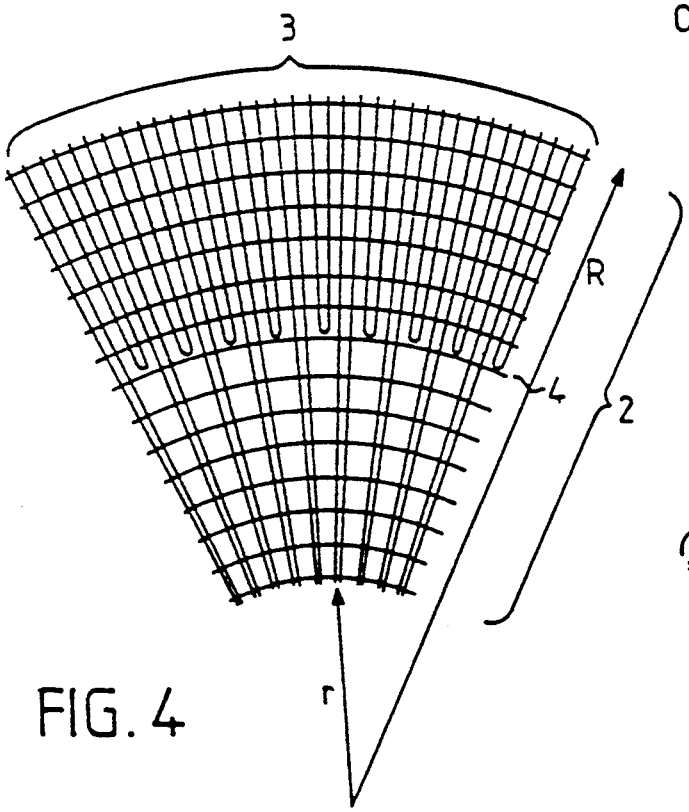

Generally, the textile structure is such that each circumferential yarn serves as reference yarn for at least one radial yarn. If FIG. 4, which represents a textile structure which does not correspond to the invention and is woven so that a single circumferential yarn, yarn 4 in this case, serves as reference for all the radial yarns, is examined, it appears clearly that this textile structure is not uniform. The content of fiber has in particular a great discontinuity around the reference yarn 4. Furthermore, the content of fiber decreases substantially from the yarn 4 towards the outer radius R and increases from the yarn 4 towards the inner radius r.

It can furthermore be noted that in a textile structure according to the invention, such as is illustrated in FIG. 3, the points of return or of increase of the weft yarns are dispersed over the entire surface of the fabric in order to obtain the desired homogeneity the fabric formed.

Figure 5:
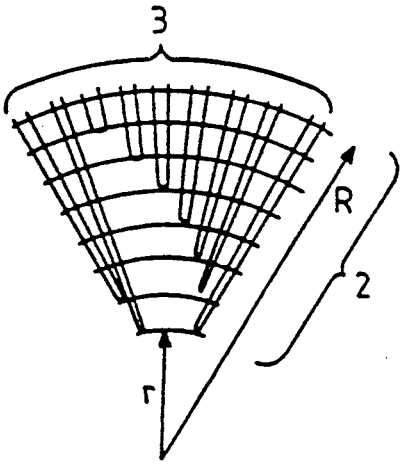

This dispersion makes it possible to smooth the variations in content of fiber in the fabric. It can be understood that it is necessary to disperse the weft yarns of different lengths. Thus, it appears that in the weaving illustrated in FIG. 3, weft yarns of relatively great length alternate with weft yarns of relatively short length. Referring to FIG. 5, which illustrates an example of textile structure which does not correspond to the invention and in which there is no dispersion of the points of increase or alternation between the relatively long weft yarns and those which are relatively short, it can be noted that, in this type of textile structure, non-contextured regions appear. The textile structure according to the invention, such as is illustrated in FIG. 3, makes it possible to avoid such non-compact regions.

The homogeneity of the spiral-shaped textile structure according to the invention is thus obtained by virtue of the fact that each warp yarn serves as reference yarn for at least one weft yarn and that the points of increase or of return are distributed in order to obtain a homogeneous structure.

The program or the plan for weaving of the textile structure is defined in order that these two conditions are met, by calculation, according to the technical characteristics it is desired to obtain for the textile structure. One skilled in the art can possibly use a computer for carrying out this calculation.

It is to be noted that the spiral-shaped textile structure according to the invention is not necessarily present over the entire surface of a piece of spiral-shaped fabric. It is in fact possible to envisage making a piece of spiral-shaped fabric in which only a region corresponding to a set of successive circumferential yarns is woven so as to have the textile structure according to the invention. It is thus only in this region which is woven according to the invention that the piece of fabric will have the homogeneity which the invention makes it possible to obtain.

It has been indicated above that the yarns were woven so as to obtain the weave selected beforehand for the fabric. It can be noted that the weave selected can be identical over the entire width of the fabric but that it is also possible to distribute different weaves in the width of the spiral in order, in particular, to give the fabric special characteristics. Thus, referring to FIG. 6, the spiral fabric can, for example, be broken down into three adjacent parts P, $P_1$, $P_2$, the part P being delimited by the inner radius and the radius $r_1$, the part $P_1$ by the radii $r_1$ and $r_2$, and the part $P_2$ by the radius $r_2$ and the outer radius R. It is then possible to weave different weaves in the parts P, $P_1$ and $P_2$, for example:

(P): ribbed 2/2

($P_1$): satin 5

($P_2$): taffeta.

It can be noted that the weave selected for the fabric has substantially no influence on the plan for weaving of the textile structure according to the invention as far as the surface mass is concerned.

Thus, a weaving plan determined for a first textile structure woven according to a given weave, in such a manner that this textile structure has in particular a given homogeneous surface mass, can be used for a second textile structure woven according to three different weaves, such as that illustrated in FIG. 6, insofar as the surface mass of this second structure is practically identical to that of the first structure.

Thus, if the selection of weave has only slight influence on the surface mass, it has, in contrast, a relatively great influence on the thickness of the fabric, since the weave corresponds to a certain relief. Consequently, if it is desired that, for example, the second textile structure has a thickness identical to that of the first textile structure, the weaving plan will have to be modified. The surface mass will then generally no longer be constant over the entire surface of this second structure. Each part P, $P_1$, $P_2$ will have its own surface mass, which will in general be different from the others.

An exemplary embodiment of a weaving machine, which makes it possible to make the textile structure according to the invention, will now be described with reference to FIGS. 7 and 8.

In this exemplary embodiment, only five warp yarns have been represented.

Figure 7:
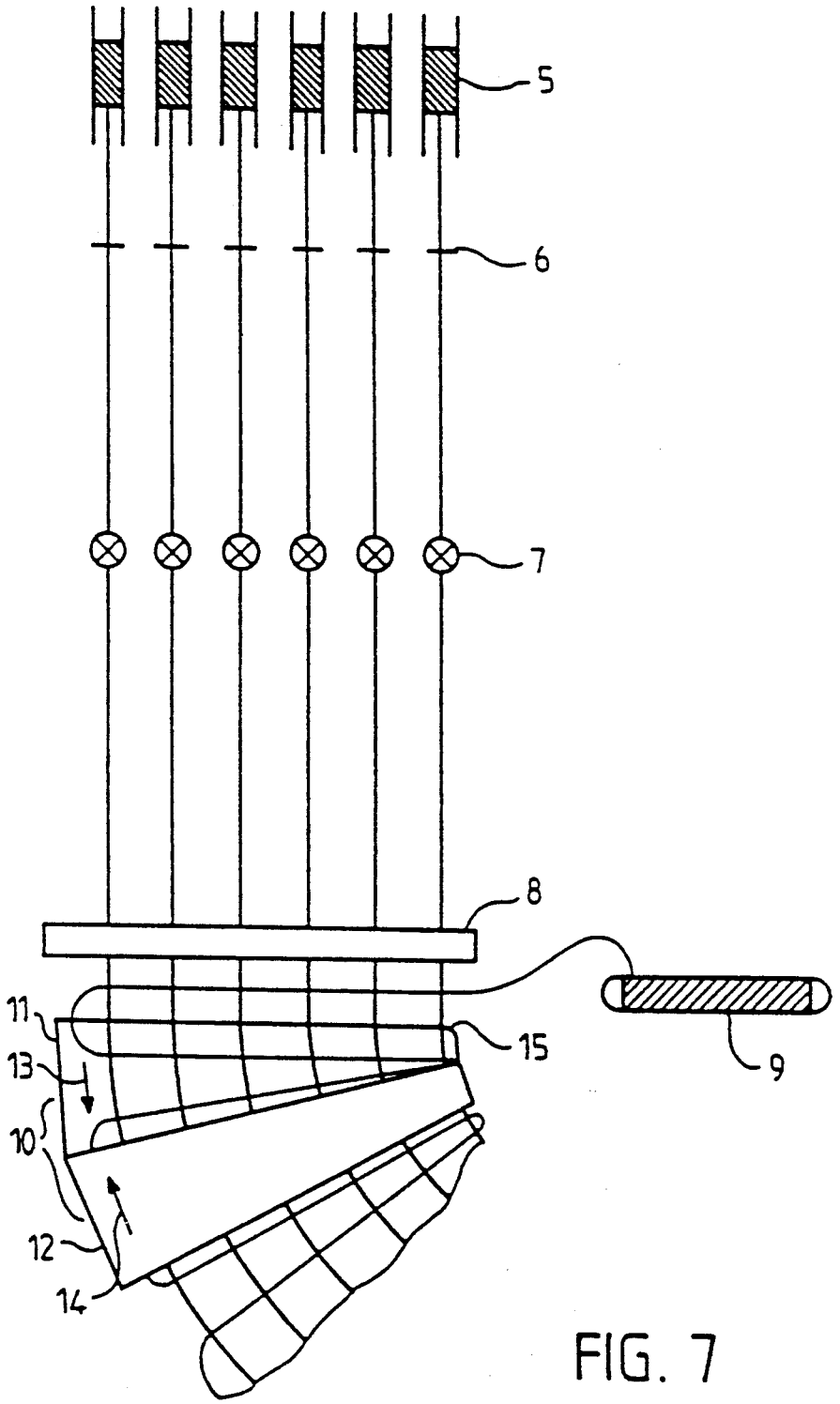
Figure 8:
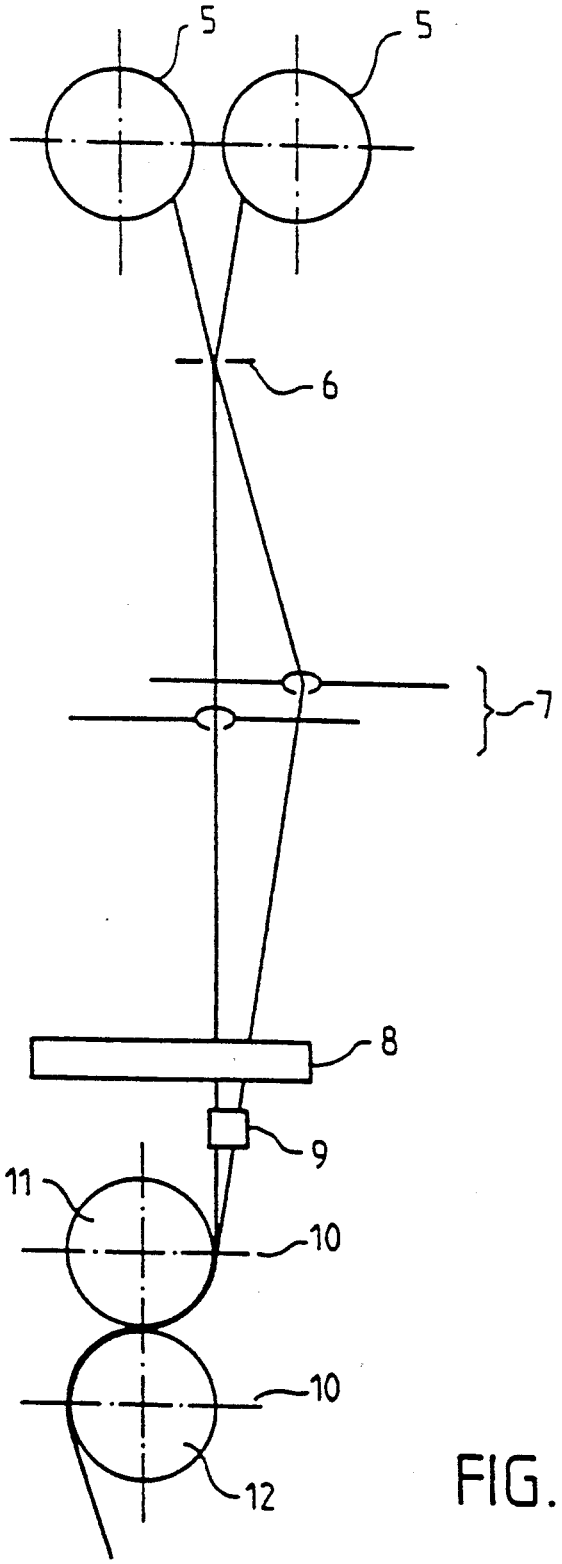

From upstream to downstream, the weaving machine comprises, successively, the following devices:

(1) a bobbin creel 5 supporting n bobbins of warp yarns (in this example, n=5), (2) tension devices 6 for the warp yarns, in particular of the weight, tension device and brake type, downstream of the creel, (3) elements for guiding the yarns downstream of the creel, which are not represented in FIGS. 7 and 8 and which can be situated downstream or upstream of the tension devices, (4) a system 7 of selection of the warp yarns.

This selection system can consist of one or more devices of the mechanical Jacquard type, these devices being such that each yarn is controlled independently of the others and this selection system thus carrying out individual selection of the warp yarns.

When this weaving machine is used for a spiral-shaped fabric in which only one annular region, which corresponds to a set of successive circumferential yarns, is woven so as to have the textile structure according to the invention, this selection system can also comprise in combination one or more devices for individual selection of the warp yarns for the weaving of the annular region, and one or more devices for selection by groups of yarns (for example, dobby system, eccentrics, etc.) for the weaving of the other regions.

The selection system makes it possible to make the desired distribution of the points of increase, taking account of the structure to be made.

(5) a comb 8, the space between each tooth of which can either be constant or variable according to the desired warp compactness, (6) a weft needle 9, in particular of the shuttle (to-and-fro movement), rapier or projectile type, (7) a draw system 10 for the warp yarns, downstream of the weft-threader, composed of one or more tapered rollers which come into engagement with one another. In the example represented, the take-up system 10 comprises two tapered drawing rollers 11 and 12.

The roller 11 rotates in the direction of the arrow 13 whereas the roller 12 rotates in the direction of the arrow 14. Preferably, the surfaces of the rollers 11 and 12 are rendered non-sliding by covering them, for example, with a sheet of emery cloth or with a layer of rubber which possibly has reliefs.

Furthermore, the take-up system 10 is preferably positioned as close as possible to the comb 8. In fact, the portion of fabric between the comb 8 and the line of first contact between the fabric and the roller 11 undergoes deformations, in particular because the warp yarns are taken-up according to different lengths when they are connected by a weft yarn. These deformations have a negligible influence when the comb 8 and the take-up system are as close as possible to one another.

The tapered roller 11 situated closest to the comb can be positioned in different ways.

It can, in particular, be positioned as represented in FIG. 7, in which the fabric formed upon leaving the comb 8 remains in a plane to which the roller 11 is tangent along a generating line 15.

It can also be arranged so that its axis is parallel to the direction of transverse movement of the weft-threader, or, again, to the last row of weft yarn unwound. The portion of fabric comprised between the comb 8 and the line of first contact between the fabric and the roller 11 takes the form of a ruled skew surface. This arrangement is not represented in the figures.

It goes without saying that when the take-up system 10 comprises at least one additional roller, this (or these) roller(s) is (are) arranged so as to come into engagement with the roller 11 and, as the case may be, other rollers, whatever the position of the roller 11.

Thus, the process for weaving a spiral-shaped textile structure, by means of a weaving machine such as has just been described, consists in drawing from upstream to downstream, or positively, a layer of warp yarns by virtue of a take-up system situated downstream of the comb. The take-up system comprises at least one roller of a tapered shape and the fabric thus receives a curvature which gives it a helicoidal shape. It is then rolled up manually or by means of a receiving device known to the one skilled in the art.

Upon each passage of the weft needle, the warp yarns are selected across which the weft yarn is unwound, each weft yarn extending between a warp yarn, known as the starting yarn, and another warp yarn, known as the reference yarn. The selection is carried out in an individual manner by virtue of means of selection of the yarns such as the system 7. It is carried out in such a manner that each warp yarn serves as reference for at least one weft yarn and that the reference yarns are distributed in order to obtain a homogeneous textile structure.

Furthermore, the weft yarns are woven so as to provide points of tying corresponding to the weave selected, and it is understood that, as indicated above, it is possible to select different weaves corresponding to different annular regions of the textile structure.

The weaving process can also be used to make a spiral fabric which has the textile structure according to the invention in only one annular region. In this case, the warp yarns are selected in an individual manner in this annular region and by group of yarns in the other regions.

The invention and the advantages which it affords in relation to known techniques will be still better demonstrated by the comparisons carried out with regard to the thickness and the surface mass of spiral-shaped fabrics obtained according to known techniques and according to the invention, these comparisons being illustrated by exemplary embodiments.

The comparison is to be carried out between two spiral-shaped fabrics, one, designated henceforward as spiral fabric A or C, is obtained by means of the technique according to the invention and the other, designated henceforward as spiral fabric B or D, is obtained by the technique in the patent FR-2 490 687.

These two spiral fabrics take the form of a strip which describes a spiral of inner radius r and outer radius R, these two radii having the same origin. Furthermore, it is borne in mind that the type of the fibers used to make these fabrics, the average surface mass and the mass distributions in warp and in weft are identical for the two fabrics.

In order to carry out the comparison with regard to the thickness of the fabrics, it has been chosen, for spiral fabric B, to make a fabric comprising three contiguous sections, delimited by the inner radius r, the outer radius R and two intermediate radii $r_3$ and $r_4$, such that $r<r_3<r_4<R$, being close to the center of the fabric whereas $r_3$ is close to the inner radius r.

FIG. 9 illustrates the comparison which can be caried out between the spiral fabric A and the spiral fabric B. FIG. 9*a* relates to the spiral fabric A whereas FIG. 9*b* relates to the spiral fabric B. These two figures are graphs which have on the X-axis the radius rn of the fabric and on the Y-axis its thickness e.

The minimum thickness of the spiral fabric A is designated as $ep_1$, the maximum thickness of the spiral fabric A as $ep_2$, the minimum thickness of the spiral fabric B as $ep_3$ and the maximum thickness of the spiral fabric B as $ep_4$.

When the dispersion of the thickness values is compared, it is noted that the maximum deviation in thickness for the fabric A which is equal to $(ep_2-ep_1)$ is much lower than the maximum deviation in thickness of the fabric B which in turn is equal to $(ep_2-ep_3)$.

It appears that the spiral fabric A has a much more regular thickness than that of the spiral fabric B.

By way of example, two spiral fabrics A and B were made, the characteristics of which are as follows:

warp material: carbon HR 3000 filaments
weft material: carbon HR 3000 filaments
weave: taffeta
average surface mass: 195 g/mz
percentage of circumferential fibers: 50%
percentage of radial fibers: 50%
inner diameter: 50 mm
outer diameter: 400 mm.

The spiral fabric B was made with two intermediate radii $r_3$ and $r_4$, equal to 100 and 200 mm respectively.

The values of average, maximum and minimum thickness measured as well as that of maximum deviation in thickness, which is equal to the difference between the value of maximum thickness and that of minimum thickness, are as follows:

| | Spiral fabric A | Spiral fabric B |
|---|---|---|
| Average thickness | 0.25 mm | 0.25 mm |
| Maximum thickness | 0.26 mm | 0.27 mm |
| Minimum thickness | 0.24 mm | 0.23 mm |
| Maximum deviation in thickness | 0.02 mm | 0.04 mm |

It can thus be noted that although the average thicknesses are identical for the two spiral fabrics, the maximum deviation in thickness is reduced by half in the case of the spiral fabric A.

The regularity of thickness of the spiral fabric A will in particular be appreciated in a case in which it is desired to stack numerous spiral fabrics on top of each other, at the same time having regard for good planeness.

In fact, the differences in thickness which exist on one turn of fabric will be accentuated in a stack of a number of whorls because, for example in the case of the spiral fabric B, these different thicknesses will accumulate.

In the spiral fabric A, the irregularities in thickness are smaller, and, above all, located in a random manner in the fabric. Thus, instead of accmulating as in the case of the spiral fabric B, the differences in thickness will compensate for one another in a structure made from spiral fabrics.

The interest of the spiral fabric A, by virtue, in particular, of the good homogeneity of thickness which it has, is thus particularly apparent when it is used to make stacks.

In order to carry out the comparison with regard to the surface mass of the fabrics, it was decided to make the spiral fabric B in the form of a fabric comprising two contiguous sections, delimited by the inner radius r, the outer radius R and an intermediate radius $r_5$.

By way of example, two spiral fabrics C and D were made, the characteristics of which are as follows:

outer diameter: 625 mm
inner diameter: 100 mm
warp material: glass E, 300 tex
weft material: glass E, 300 tex
weave: taffeta
average surface mass: 350 g/m$^2$
mass distribution of warp fibers: 50%
mass distribution of weft fibers: 50%

The spiral fabric D was made with an intermediate radius $r_5$ equal to 250 mm.

The values of average, maximum and minimum surface mass measured, as well as that of maximum deviation in surface mass, which is equal to the difference between the value of maximum surface mass and that of minimum surface mass, are as follows:

| | Spiral fabric C | Spiral fabric D |
|---|---|---|
| Average surface mass | 350 g/m$^2$ | 350 g/m$^2$ |
| Maximum surface mass | 360 g/m$^2$ | 390 g/m$^2$ |
| Minimum surface mass | 340 g/m$^2$ | 310 g/m$^2$ |
| Maximum deviation | 20 g/m$^2$ | 80 g/m$^2$ |

-continued

| | Spiral fabric C | Spiral fabric D |
|---|---|---|
| in surface mass | | |

Comparing these values, it is noted that it is possible, in this example, to reduce by 60 g/m$^2$ the maximum deviation in the case of the spiral fabric C.

This illustrates clearly that the spiral-shaped textile structure according to the invention has a surface mass which is much more homogeneous than the fabrics made according to known weaving techniques.

This advantage will be particularly appreciated in a case in which it is attempted to obtain constant contents of fibers, for example in the making of composites.

We claim:

1. A spiral-shaped textile structure, comprising:

warp yarns arranged in spirals about a common axis; and successive rows of weft yarns extending across and woven with said warp yarns, forming a spiral textile structure of superimposed annular turns centered on said common axis;

wherein each said weft yarn extends between one warp yarn known as a starting yarn and another warp yarn known as a reference yarn along the radius of one turn of the textile structure, the textile structure including at least one annular region wherein each said warp yarn thereof serves as a reference yarn for at least one said weft yarn, and said reference yarns being distributed so as to obtain a homogeneous textile structure in said annular region.

2. The textile structure of claim 1, wherein said weft yarns are woven with said warp yarns so as to provide points of tying corresponding to a predetermined weave pattern.

3. The textile structure of claim 1, wherein said reference yarns are chosen so as to provide a substantially random pattern of said weft yarns while obtaining a homogenous textile structure in said annular region.

4. The textile structure of claim 1, wherein said starting yarn is the same said warp yarn for all of said weft yarns in said annular region.

5. The textile structure of claim 4, wherein said starting yarn is the radially furthest said warp yarn from said common axis.

6. The textile structure of claim 1, wherein said starting yarn varies for at least some of said weft yarns in said annular region.

* * * * *